United States Patent [19]

Morino et al.

[11] Patent Number: 5,056,496

[45] Date of Patent: Oct. 15, 1991

[54] IGNITION SYSTEM OF MULTISPARK TYPE

[75] Inventors: Seiji Morino, Okazaki; Yasuhito Takasu, Toyohashi; Kozo Takamura, Nagoya; Masato Somiya, Anjo, all of Japan

[73] Assignee: Nippondenso Co., Ltd., Kariya, Japan

[21] Appl. No.: 492,472

[22] Filed: Mar. 12, 1990

[30] Foreign Application Priority Data

Mar. 14, 1989 [JP] Japan ..... 1-61823
Aug. 1, 1989 [JP] Japan ..... 1-199894

[51] Int. Cl.[5] ..... F02P 15/10

[52] U.S. Cl. ..... 123/604; 123/606; 123/608; 315/209 CD; 361/256

[58] Field of Search ..... 123/606, 607, 608, 637, 123/604; 315/209 CD; 361/256

[56] References Cited

U.S. PATENT DOCUMENTS

| | | | |
|---|---|---|---|
| 3,372,682 | 3/1968 | Phillips et al. | 123/604 |
| 3,459,164 | 8/1969 | Gilbert | 123/604 |
| 3,906,919 | 9/1975 | Asik et al. | 123/606 |
| 3,945,362 | 3/1976 | Neuman et al. | 123/606 |
| 4,149,508 | 4/1979 | Kirk, Jr. et al. | 123/606 |
| 4,326,493 | 4/1982 | Merrick | 123/606 |
| 4,892,080 | 1/1990 | Morino et al. | 123/604 |
| 4,967,718 | 11/1990 | Scarnera | 123/604 |

FOREIGN PATENT DOCUMENTS

| | | |
|---|---|---|
| 56-41685 | 4/1981 | Japan . |
| 64-27176 | 1/1989 | Japan . |

*Primary Examiner*—Andrew M. Dolinar
*Attorney, Agent, or Firm*—Cushman, Darby & Cushman

[57] ABSTRACT

An ignition system of multispark type having an ignitability superior to that of a combination an ignition system of capacitor discharge type and a multispark system is disclosed. A first control signal is generated for turning on a first switching device a predetermined time before an ignition timing to store energy in an energy storage coil and turning off the first switching device at the ignition timing. A multispark control signal is generated for turning on a second switching device from the ignition timing and turning on and off the first and second switching devices alternately for a predetermined spark period. A second control signal is generated for turning on the first switching device upon the turning off of the second switching device to store energy in the energy storage coil and then turning off the first switching device to charge a capacitor with the energy stored in the energy storage coil.

9 Claims, 12 Drawing Sheets

IGNITION SYSTEM OF MULTISPARK TYPE

BACKGROUND OF THE INVENTION

The present invention relates to an ignition system of multispark type used mainly with an internal combustion engine.

Conventional ignition systems for producing a sufficient ignition energy at an ignition timing include a combination of an ignition system of capacitor discharge type and an ignition system of multispark type (as disclosed, for example, in U.S. Pat. No. 3906919), or include a system for supplying an ignition system of multispark type with the energy stored in an energy storage coil (as disclosed, for example, in U.S. Pat No. 4326493).

The former system, which is a simple combination of an ignition system of capacitor discharge type and an ignition system of multispark type, requires two types of coils, i.e., those for capacitor discharge and multiple ignitions as the primary windings of the ignition coil. This in turn requires three large-capacity switching devices for driving the primary windings, and a DC-DC converter exclusively used for the ignition system of capacitor discharge type. The resulting requirement of a great number of parts and a complicated construction poses the problem of high cost.

The latter conventional system, on the other hand, in which energy stored in the energy storage coil is only supplied to an ignition system of multispark type, has a disadvantage of small spark current in initial stage of ignition leading to an inferior ignitability as compared with the former conventional system, that is, the ignition system of capacitor discharge type.

SUMMARY OF THE INVENTION

Accordingly, the object of the present invention is to provide an ignition system of multispark type having a comparatively simple configuration which produces an ignition performance at least equivalent to a combination of the ignition systems of capacitor discharge type and multispark type.

According to one aspect of the present invention, there is provided an ignition system of multispark type comprising a first series closed circuit including a DC power supply, an energy storage coil and a first switching device, a second series closed circuit including the energy storage coil, a reverse flow blocking means, the primary winding of the ignition coil and a second switching device, a capacitor connected to the energy storage coil through the reverse flow blocking means, first control signal generating means for generating a first control signal for turning off the first switching device at an ignition timing after being turned on a predetermined time before the ignition timing to store energy in the energy storage coil, means for generating a multispark control signal for turning on and off the first and second switching devices alternately during a predetermined spark period after turning on the second switching device from the ignition timing, and means for generating a second control signal for charging the capacitor by the energy stored in the energy storage coil by turning off the first switching device after being turned on to store energy in the energy storage coil while the second switching device is turned off.

In this configuration, the first switching device is turned on a predetermined time before an ignition timing by the first control signal generation means thereby to store energy in the energy storage coil, after which the first switching device is turned off at the ignition timing. The second switching device is then turned on from the ignition timing by the multispark control signal generation means, so that the primary winding of the ignition coil is supplied with the energy stored in the capacitor in advance and the energy stored in the energy storage coil. During a predetermined spark period thereafter, the multispark control signal generation means generates a multispark control signal for alternately turning on and off the first and second switching devices, thus supplying an ignition energy periodically to the ignition coil from the energy storage coil during the spark period. Also, the second control signal generation means turns on the first switching device while the second switching device is turned off, and after thus storing energy in the energy storage coil, the first switching device is turned off and the capacitor is charged by the energy stored in the energy storage coil.

DESCRIPTION OF THE PREFERRED EMBODIMENTS

Figure 1:
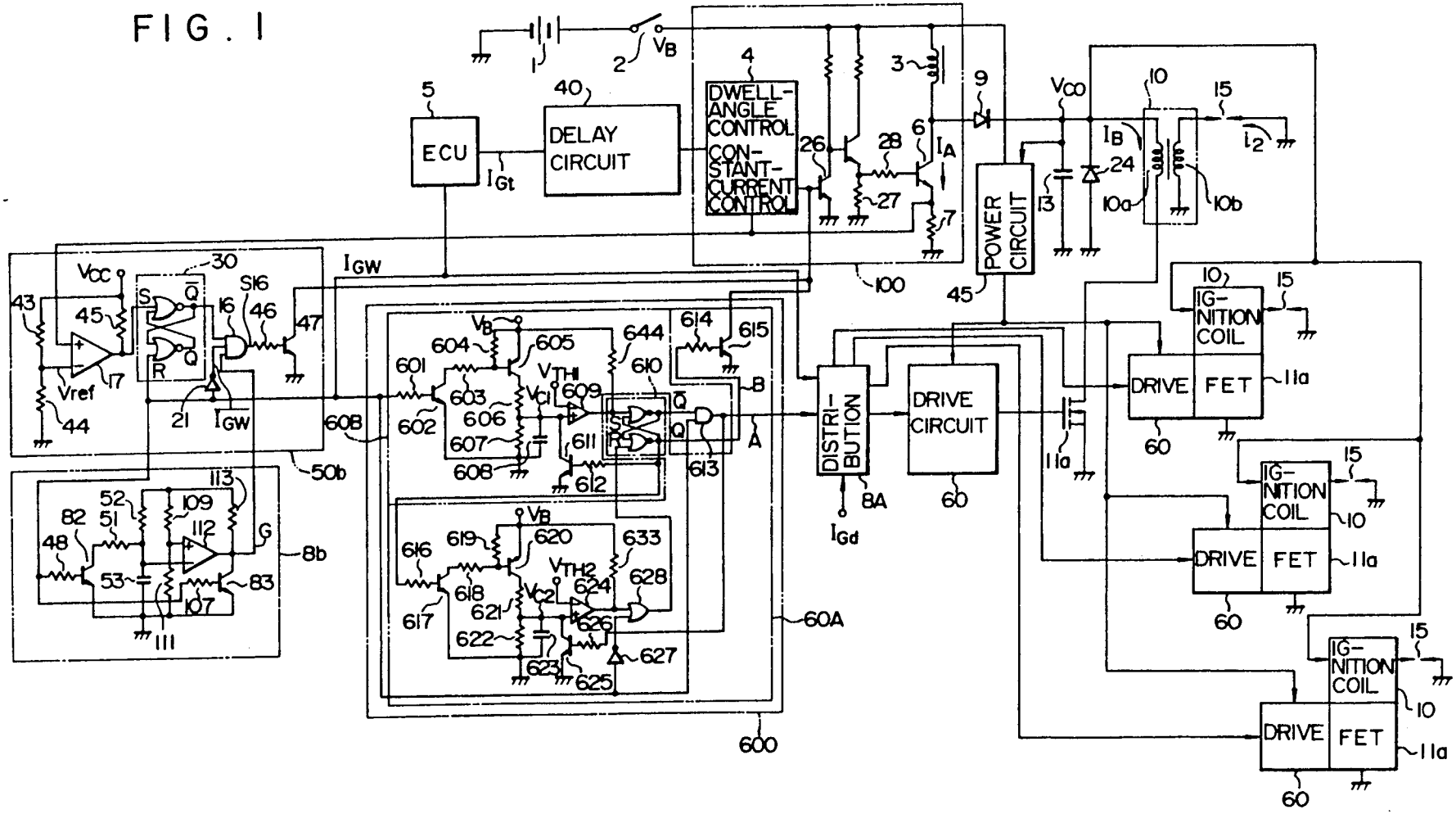
FIG. 1 is a diagram showing an electrical circuit according to a first embodiment of the present invention.
Figure 2:
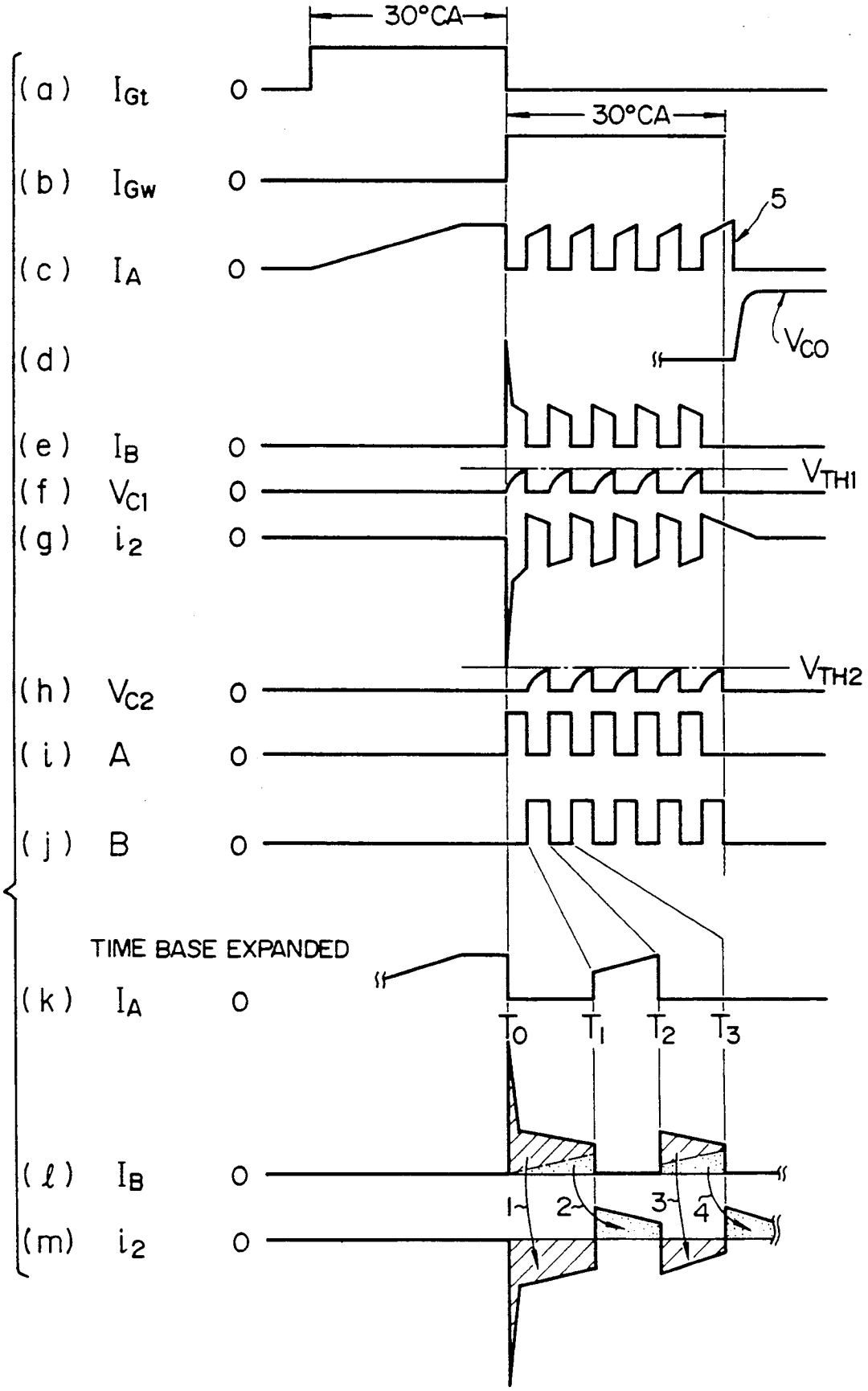
FIGS. 2 and 3 show waveforms at various parts of the system shown in FIG. 1 for explaining the operation thereof.

A first embodiment applied to an ignition system for the internal combustion engines is shown in FIG. 1. The negative side of a battery 1 providing a DC power supply is connected to the earth, and the positive side thereof to an end of an energy storage coil 3 through a key switch 2. The other end of the coil 3 is connected to the collector of a power transistor 6 making up a first switching device. The emitter of the power transistor 6 is connected to the earth through a current detecting resistor 7. Reference numeral 5 designates a well known electronic control unit (ECU) configured of a computer. This ECU generates an ignition signal IGt as a first control, as shown in FIGS. 2(*a*) and 3(*a*), which rises to high level a predetermined angle (say, 30° CA) before an ignition timing and falls at the ignition timing, and a spark duration signal IGw which, as shown in FIGS. 2(*b*) and 3(*b*), rises at an ignition timing and falls a predetermined angle (say, 30° CA) thereafter. Numeral 40 designates a delay circuit for delaying the rise of the ignition signal IGt by a predetermined length of time (say, 40 μs).

The ignition signal is applied through the delay circuit 40 to a well-known dwell-angle constant-current control circuit 4. In accordance with the current IA detected by a current-detecting resistor 7, the dwell-angle constant-current control circuit 4 subjects the value of the current IA and the energization time (dwell angle) to feed-back control. The output of the dwell-angle constant-current control circuit 4 is connected to the base of a power transistor 6 through a transistor 26 and resistors 27, 28. An energy storage circuit 100 configured to include a dwell-angle constant-current control circuit 4, current detecting resistor 7, transistor 26, resistors 27, 28 and the power transistor 6 has an ignition coil replaced by the energy storage coil 3 without secondary winding in a normal ignition system of current turn-off type, and includes the other component parts identical to those in the conventional systems.

The output of the energy storage circuit 100 is supplied from the collector of the transistor 6 and is connected to an end of a capacitor 13 through diode 9 making up reverse flow blocking means. The other end of the capacitor 13 is grounded. An end of the capacitor 13 is connected to an end of the primary winding 10*a* of the ignition coil 10 of each cylinder of the internal combustion engine, and the other end of the primary winding 10*a* of each ignition coil 10 is connected to the drain of the MOS FET 11*a* of each cylinder making up a second switching device. The source of each of the FETs 11*a* is grounded. An end of the secondary winding 10*b* of each ignition coil 10 is grounded, and the other end thereof is connected to the ignition plug of each cylinder. The capacitor 13 is connected in reverse parallel to a diode 24.

Figure 3:
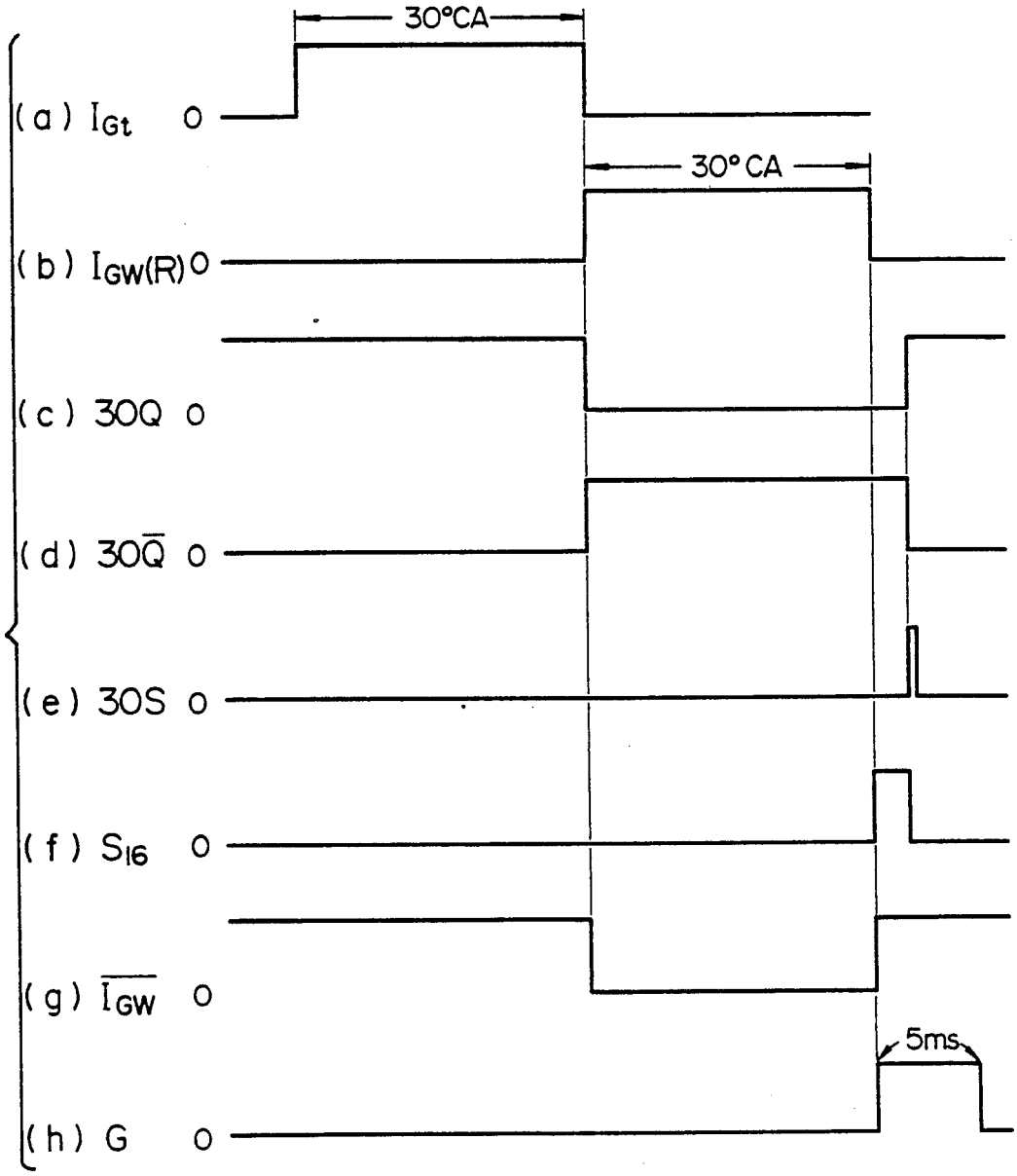

Numerals 8*b*, 50*b* designate a constant-current control circuit and a monostable multivibrator circuit respectively making up control signal generation means. The constant-current control circuit 50*b* turns on the power transistor 6 at the end of generation of the spark duration section signal IGw, and when the current IA flowing in the power transistor 6 exceeds a predetermined value, turns off the power transistor 6. FIG. 3(*f*) shows a signal generated by the constant-current control circuit 50*b*. The monostable multivibrator circuit 8*b*, on the other hand, is for forcibly turning off the power transistor 6 in the case where the current IA flowing in the power transistor 6 fails to reach a predetermined value after the lapse of a predetermined length of time (say, 5 ms) from the turning on of the power transistor 6 at the end of generation of the spark duration signal IGw. FIG. 3(*h*) shows a signal of monostable output produced by the monostable multi-vibrator circuit 8*b*. Numeral 600 designates multiple discharge control signal generation means for turning on and off the power transistor 6 and the FET 11*a* alternately during the generation of the spark duration signal IGw. The signal generation means 600 includes source voltage-responsive conduction time-determining means 60A, 60B for generating multispark control signals as shown in FIGS. 2(*i*), (*j*) respectively to turn on and off the power transistor 6 and the FET 11*a* for a time length corresponding to the source voltage of the battery 1.

The output of one of the source voltage-responsive conduction time-determining means 60A is connected to the base of the transistor 26, and the output of the other source voltage-responsive conduction time-determining means 60B is supplied through a distribution circuit 8A to the driving circuit of each cylinder. The output of each driving circuit 60 is connected to the gate of each FET 11*a*. The distribution circuit 8A is for distributing the output of the source voltage-responsive conduction time-determining means 60B among the driving circuits 60 of the cylinders by the sections IGw of the spark duration signal. Numeral 45 designates a power supply circuit for preparing a driving power supply for each driving circuit 60 by the charge voltage of the capacitor 13 and the battery 1.

The constant-current control circuit 50*b* includes an AND gate 16, a comparator 17, an inverter 21, a flip-flop 30, resistors 43 to 46 and a transistor 47. The monostable multivibrator circuit 8*b* is comprised of resistors 48, 51, 52, 107, 109, 111, 113, a capacitor 53, transistors 82, 83 and a comparator 112.

The source voltage-responsive conduction time-determining means 60A includes resistors 614, 616, 618, 619, 621, 622, 626, 633, transistors 615, 617, 620, 625, a capacitor 623, a comparator 624, an inverter 627, an OR gate 628 and a flip-flop 610, and the source voltage-responsive conduction time-determining means 60B includes resistors 601, 603, 604, 606, 607, 612, 644, transistors 602, 605, 611, a capacitor 608, comparator 609, an AND gate 613 and a flip-flop 610.

The operation of this system having the aforementioned configuration will be explained with reference to the waveforms produced at various parts shown in FIG. 2. The ignition signal IGt of high level produced from the ECU 5 shown in FIG. 2(*a*) turns on the power transistor 6, and energy is stored in the energy storage coil 3 by the battery 1. At time $T_0$ providing an ignition timing when the ignition signal IGt is reduced to low level, the source voltage-responsive conduction time-determining means 60A produces an output signal A of high level shown in FIG. 2(*i*). This signal A is supplied to the driving circuit 60 of each cylinder through the distribution circuit 8A, so that the output signal of the driving circuit 60 turns on the FET 11*a* of each cylinder. As a result, electron charges already stored in the capacitor 13 are supplied to the primary winding 10*a* of the ignition coil 10 of the particular cylinder through the corresponding FET 11*a*. The power transistor 6 is turned off in a certain time delay set by the delay circuit 40 after fall of the ignition signal IGt to low level at the time $T_0$ providing an ignition timing, so that the energy stored in the energy storage coil 3 is combined with the energy of the capacitor 13, and the current shown in FIG. 2(*e*) is thus supplied to the primary winding 10*a* of the ignition coil 10 of the particular cylinder, whereby a secondary current shown in FIG. 2(*g*) flows in the secondary winding 10*b* of the ignition coil 10, thereby generating an ignition spark in the ignition plug 15. While the spar duration signal IGw is generated, the source voltage-responsive conduction time-determining means 60A, 60B alternately generate the multispark control signals A and B of a predetermined time width determined by the battery voltage as shown in FIGS.

2(*i*), 2(*j*). The power transistor 6 and the corresponding FET 11*a* are turned on and off alternately, and thereby energy is stored periodically in the energy storage coil 3. This energy is supplied periodically to the primary winding 10*a* of the ignition coil 10 of the corresponding cylinder, with the result that a multispark current flows in the ignition plug 15 of the corresponding cylinder as shown in FIG. 2(*g*).

Also, in the constant-current control circuit 50*b*, the flip-flop 30 reset by the spark duration signal IGw shown in FIG. 3(*b*) has the $\overline{Q}$ output thereof raised to high level as shown in FIG. 3(*d*) when the spark duration signal IGw is at high level. Even when the spark duration signal IGw changes from high to low level, the output of the flip-flop 30 remains unchanged. When the spark duration signal IGw falls from high to low level, the output of the monostable multivibrator circuit 8*b* rises to high level as shown in FIG. 3(*h*). At the same time, the output of the inverter 21 rises to high level as shown in FIG. 3(*g*), and therefore all the inputs to the AND gate 16 rise to high level with the output thereof raised to high level, thereby turning on the transistor 47. As a result, the transistor 26 is turned off, the power transistor 6 is turned on, and energy is stored in the energy storage coil 3. When sufficient energy is stored in the energy storage coil 3 and so the current flowing in the power transistor 6 reaches a predetermined value, the output of the comparator 17 rises to high level and sets the flip-flop 30. The Q output of the flip-flop 30 is thus reduced to low level as shown in FIG. 3(*d*), thus turning off the power transistor 6. The capacitor 13 is charged to a predetermined voltage as shown in FIG. 2(*d*) by the energy stored in the energy storage coil 3. The charge voltage of this capacitor 13 is used for the ignition cycle of the next cylinder.

Now, explanation will be made about the multispark control signal generation means 600 with reference to the circuit diagram of FIG. 1 and the time chart of FIG. 2.

Upon application thereto of the spark duration signal IGw of high level shown in FIG. 2(*b*), the transistors 602 and 605 are turned on, so that the capacitor 608 begins to be charged by the source voltage $V_B$ through the resistor 606 and produces a waveform shown in $V_{C1}$ of FIG. 2(*f*). When the voltage $V_{C1}$ across the capacitor 608 reaches a predetermined level $V_{TH1}$, the output of the comparator 609 reaches high level and so does the set input of the flip-flop 610, thereby raising the Q output of the flip-flop 610 to high level. The resulting waveform is shown in B of FIG. 2(*j*). At the same time, the $\overline{Q}$ output of the flip-flop 610 is reduced to low level and produced in the form A of FIG. 2(*i*) through the AND gate 613. In the process, the other capacitor 623 begins to be charged with the Q output of the flip-flop 610 as a trigger, and when the voltage $V_{C2}$ shown in FIG. 2(*h*) of this capacitor 623 reaches a predetermined level $V_{TH2}$, the output of the comparator 624 rises to high level and is supplied through the OR gate 628 to the reset input of the flip-flop 610. The flip-flop 610 is thus reset. Under this condition, the capacitor 608 discharges by the Q output of the flip-flop 610, and the capacitor 623 by the waveform A, with the transistors 611 and 625 turned on respectively. This operation is repeated while the signal IGw remains high (say, during the section of 30° CA). The capacitors 608 and 623 are charged by the source voltage $V_B$ of the battery 1, and therefore the pulse width of waveforms A and B change in reverse proportion to the source voltage $V_B$. The waveform A assumes a signal with the FET 11*a* turned on and off alternately, and the waveform B with the power transistor 6 turned on and off alternately. Specifically, the multispark control signal generation means 600 makes up an oscillator of source voltage control type (with the pulse width shortened with the increase in power).

Now, the reason for availability of the multispark (continuous spark) will be explained with reference to FIGS. 2(*k*) to (*m*) expanded along time axis. During the time period from $T_0$ to $T_1$ when energy of both the capacitor 13 and the energy storage coil 3 flows in the primary winding 10*a* of the ignition coil 10, the current $i_2$ shown in FIG. 2(*m*) flows as a negative spark in the secondary winding 10*b* of the ignition coil 10, that is, the ignition plug 15, by the function of a transformer. In the process, magnetic energy ② is stored in the ignition coil 10. With the FET 11*a* turned off at the time point $T_1$, the magnetic energy ② stored flows in the ignition plug 15 as a positive spark thereby to sustain a spark. During the period from $T_1$ to $T_2$, on the other hand, sufficient energy is stored in the energy storage coil 3 regardless of the ignition coil 10 while energy ② remains unconsumed. Upon the turning on of the FET 11*a* again at time point $T_2$, only the energy ③ of the energy storage coil 3 is released to the ignition plug 15, while at the same time storing the magnetic energy ④ in the ignition coil 10. At time $T_3$, the energy ④ is released to the ignition plug 15 if the FET 11*a* is turned off. By repeating this process, the spark discharge of the ignition plug is continued while the spark duration signal IGw remains at high level.

According to this method, energy of the energy storage coil 3 is released to the ignition coil 15 during the period from $T_0$ to $T_1$, while at the same time storing magnetic energy in the ignition coil 10. During the period from $T_1$ to $T_2$, on the other hand, magnetic energy is released to the ignition plug 15, while at the same time storing energy in the energy storage coil 3. By repeating this process, spark discharge may be continuously effected at the ignition plug 15 during a multispark period.

Figure 4:
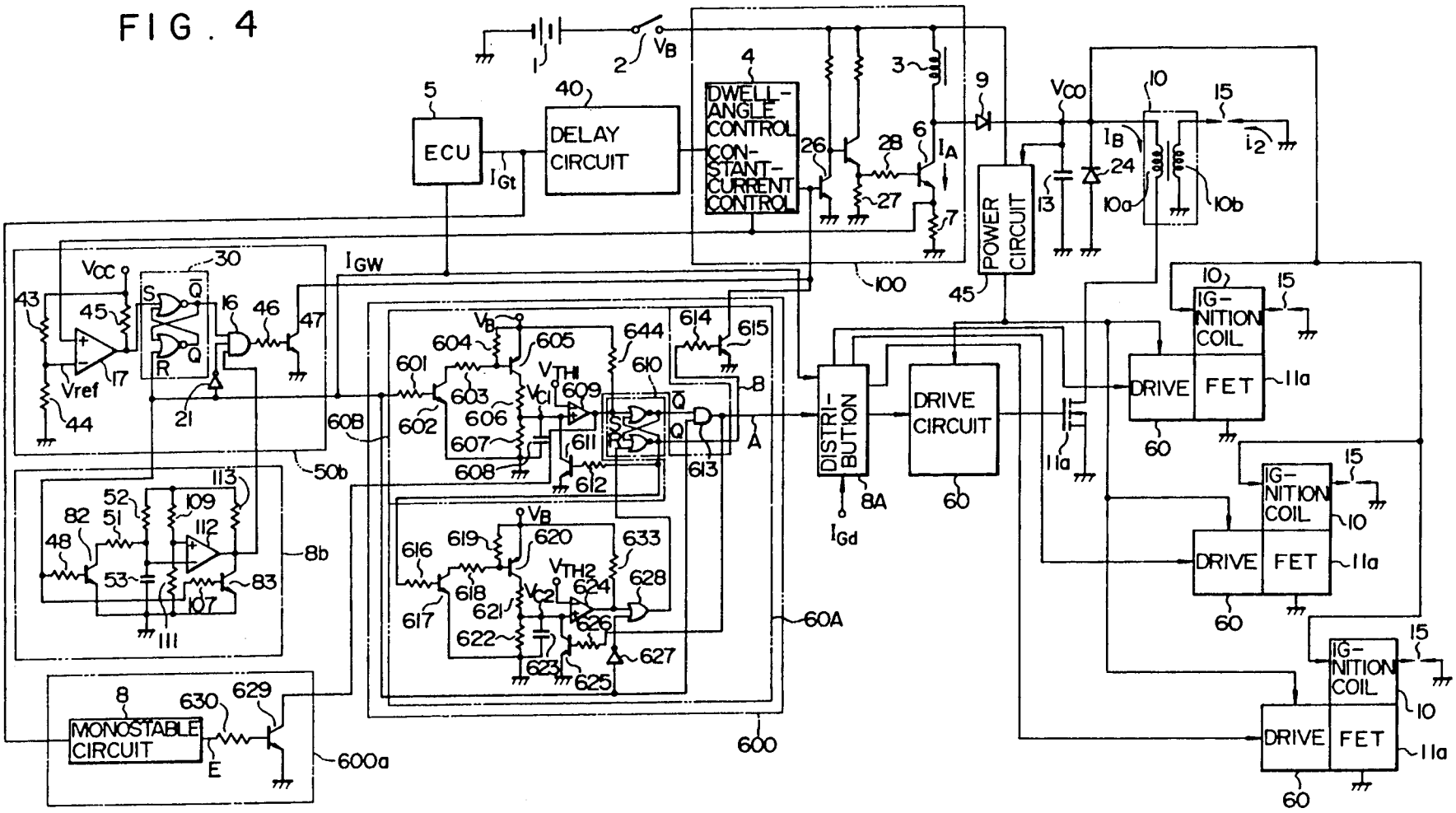
FIG. 4 is a diagram showing an electrical circuit according to a second embodiment of the present invention.
Figure 5:
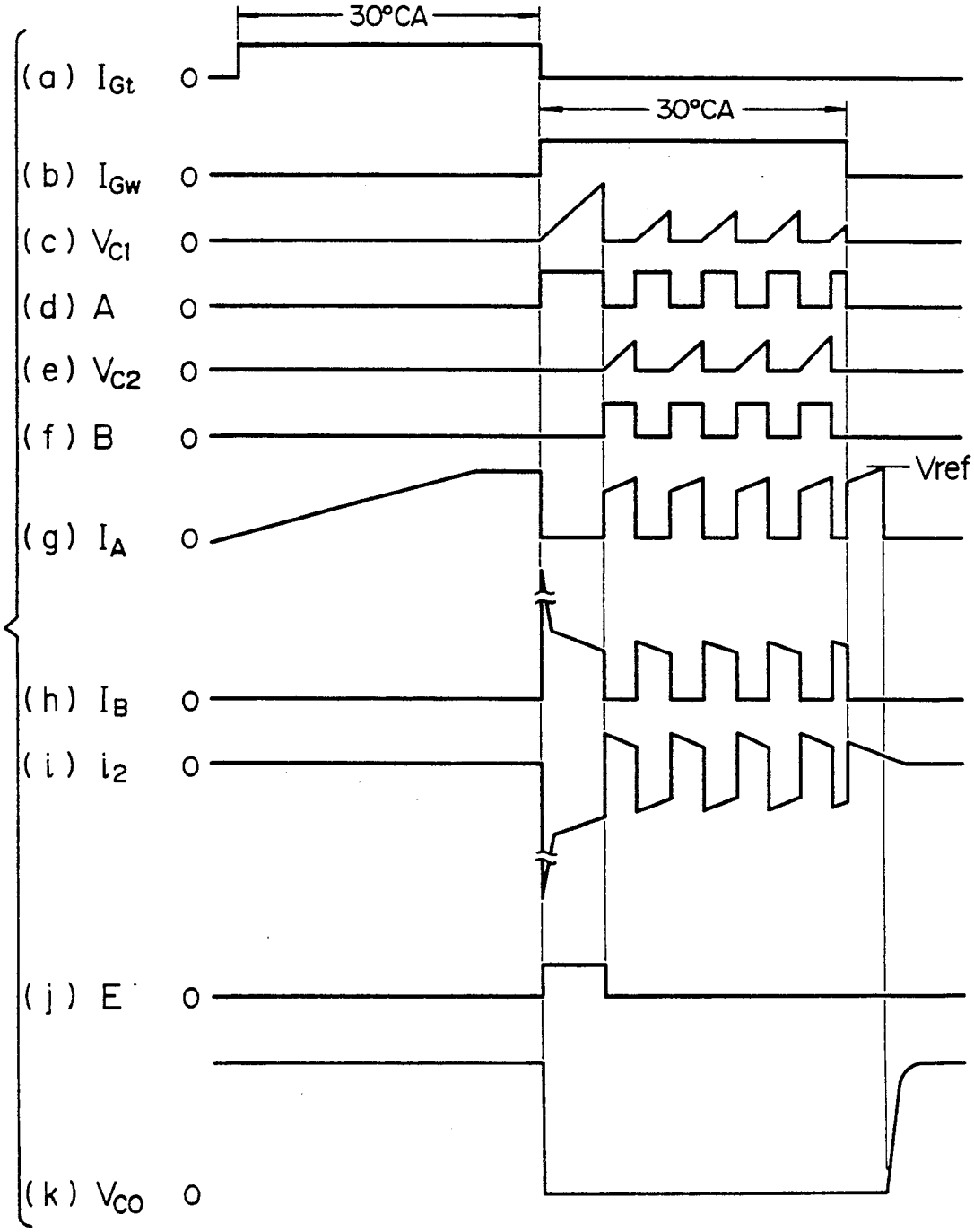
FIG. 5 shows waveforms at various parts of the system shown in FIG. 4 for explaining the operation thereof.

FIG. 4 shows a second embodiment of the present invention. Unlike the first embodiment, the second embodiment further comprises conduction time-setting means 600*a* added to the multispark control signal generation means 600 for setting the first conduction time of the FET 11*a* at an ignition timing separately from the conduction time for subsequent multispark periods. This conduction time setting means 600*a* includes a resistor 630, a transistor 629, and a monostable multivibrator circuit 8 triggered with the fall of the ignition signal IGt to produce a monostable signal of high level having a predetermined time width (say, 0.3 ms) as shown in FIG. 5(*j*). In this configuration, the transistor 629 is turned on and the output of the comparator 609 shorted while the monostable multi-vibrator circuit 8 generates a high-level monostable signal with the ignition signal IGt reduced to low level at an ignition timing. As a result, the first conduction time of the FET 11*a* at an ignition timing is lengthened by the discharge time of the capacitor 13 as compared with the conduction time during subsequent multispark periods. The waveforms produced at various parts of FIG. 4 are shown in FIG. 5.

Figure 6:
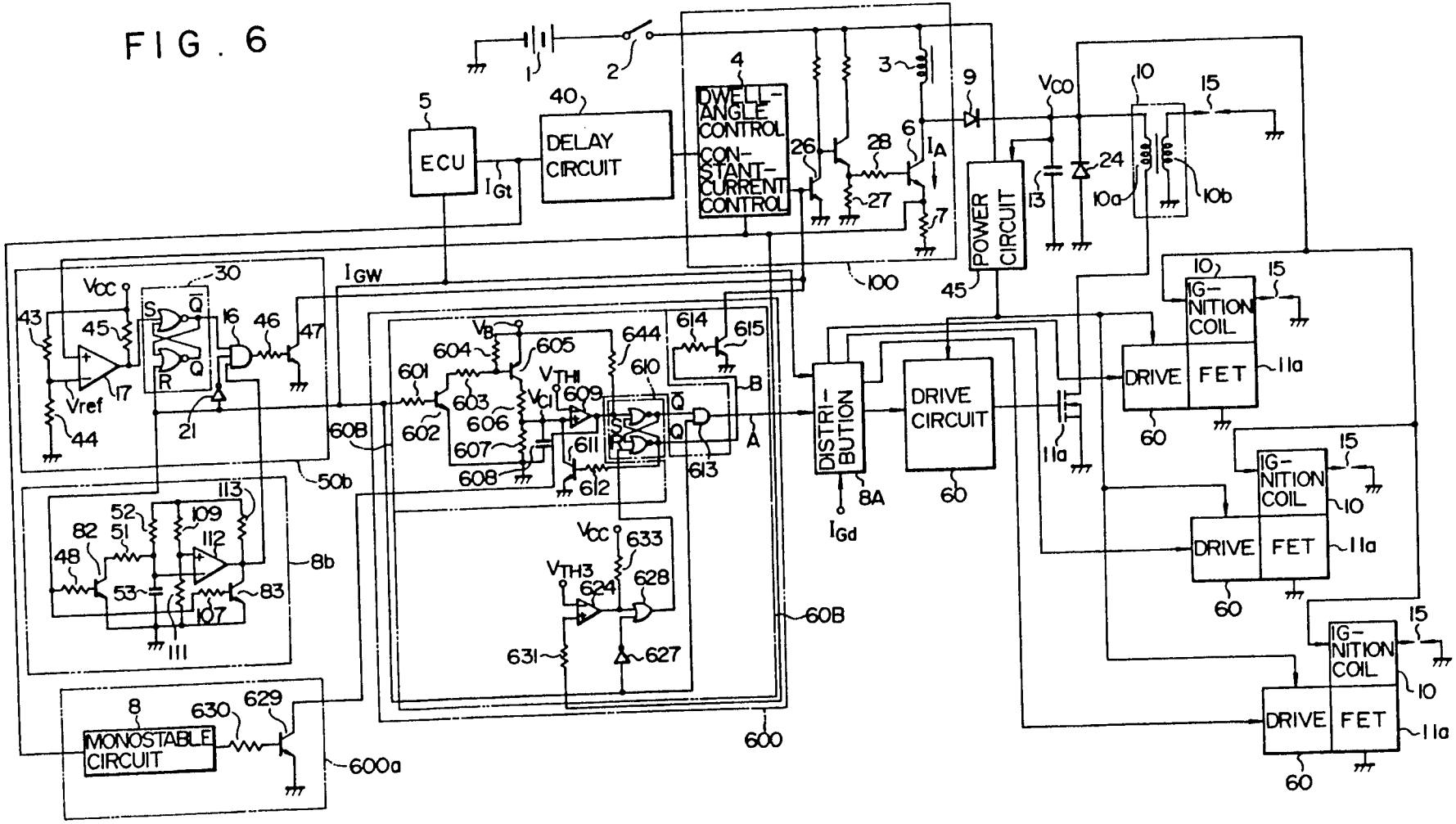
FIGS. 6 and 7 are diagrams showing electrical circuits according to third and fourth embodiments of the invention.

FIG. 6 shows a third embodiment of the present invention. As compared with the second embodiment described above, the source voltage-responsive conduction time-determining means 60A of the multispark control signal generation means 600 is replaced by current-responsive conduction time-determining means 60C for determining the conduction time of the power transistor 6 in accordance with the current flowing in the power transistor 6. This current-responsive conduction time-determining means 60C includes a flip-flop 610, resistors 614, 631, 633, a comparator 624, an inverter 627 and an OR gate 628. This current-responsive conduction time-determining means 60C is such that if the current flowing in the power transistor 6 exceeds predetermined value during the generation of the spark duration signal IGw, the output of the comparator 624 is raised to high level and the flip-flop 610 is reset through the OR gate 628, thereby turning off the power transistor 6 while at the same time turning on the FET 11*a*. According to this embodiment, therefore, the turn-off current value of the power transistor 6 during a multispark period is controlled at a uniform level regardless of the source voltage, thus stabilizing the unit energy stored in the energy storage coil 3 periodically during the multispark period.

Figure 7:
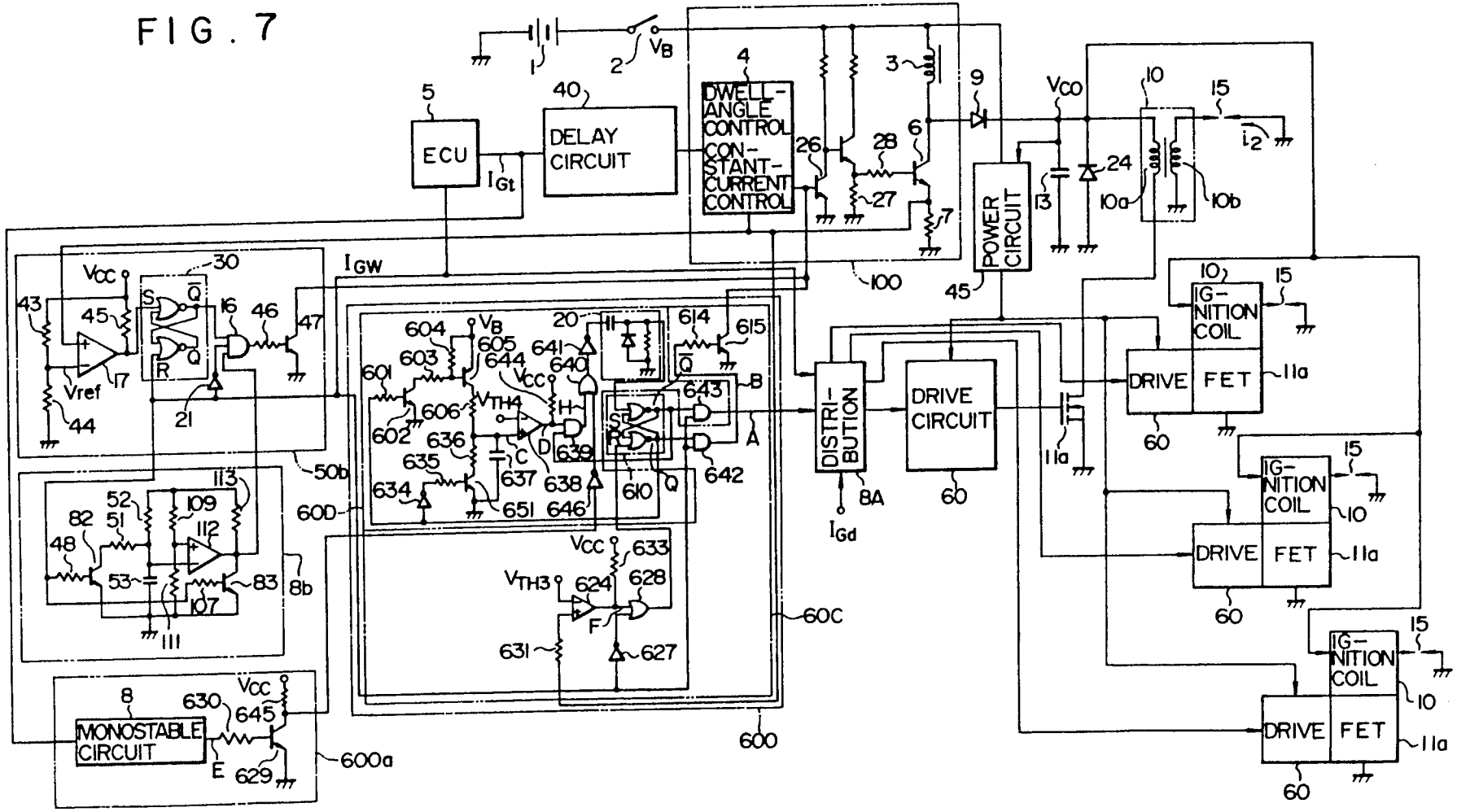

FIG. 7 shows a fourth embodiment of the invention. As compared with the third embodiment explained above, the source voltage-responsive conduction time-determining means 60B of the multispark control signal generation means 600 is replaced by first switching device-responsive conduction time-determining means 60D for determining the conduction time of the FET 11*a* to the same length as that of the power transistor 6. This first switching device-responsive conduction time-determining means 60D includes a flip-flop 610, transistors 602, 605, 651, resistors 601, 603, 604, 606, 635, 636, 644, inverters 634, 641, 646, a capacitor 637, a comparator 638, AND gates 639, 643, an OR gate 640 and a differentiation circuit 20. Also, an AND gate 642 is added to the current-responsive conduction time-determining means 60C.

Figure 8:
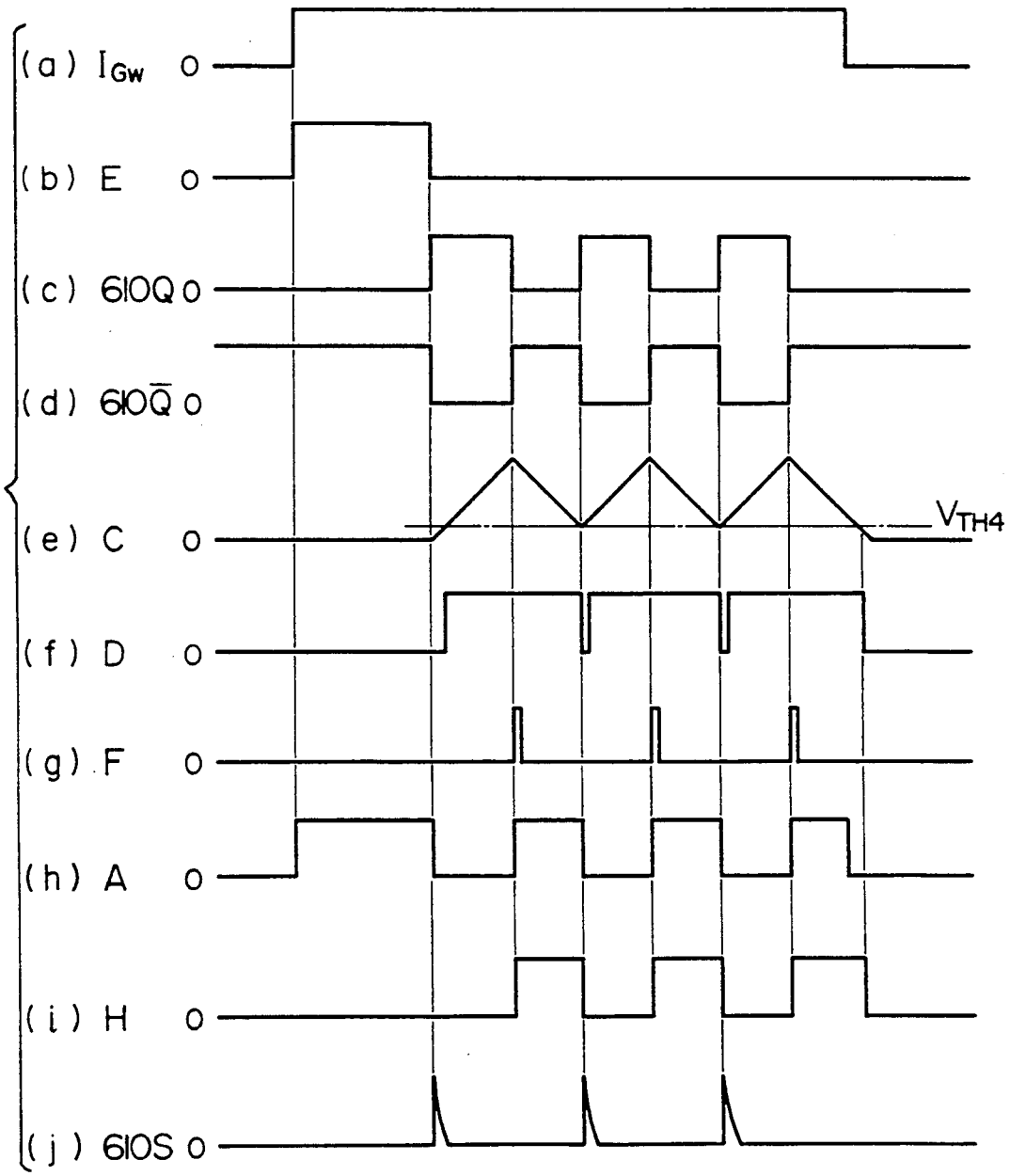
FIG. 8 shows waveforms at various parts for explaining the operation of the system shown in FIG. 7.

Waveforms produced at various points of the fourth embodiment are shown in FIG. 8. While a high-level spark duration signal IGw shown in FIG. 8(*a*) is generated, the FET 11*a* is first turned on by a monostable signal shown in FIG. 8(*a*) generated from the monostable multivibrator circuit 8 of the conduction time-setting means 600*a*. In synchronism with the fall of this monostable signal to low level, a differentiation output shown in FIG. 8(*j*) is generated from the differentiation circuit 20 to set the flip-flop 610. The Q output of the flip-flop 610 is thus raised to high level, and the $\overline{Q}$ output thereof is reduced to low level as shown in FIG. 8(*d*). With the rise of the Q output of the flip-flop 610 to high level, the capacitor 637 begins to be charged as shown in FIG. 8(*e*), and at the same time the power transistor 6 begins to conduct. When the current flowing in the power transistor 6 reaches a predetermined value, the output of the comparator 624 is raised to high level as shown in FIG. 8(*g*)to reset the flip-flop 610, thus reversing the output thereof. As a result, as shown in FIG. 8(*e*), the capacitor 637 begins to discharge, the power transistor 6 is turned off, and the FET 11*a* is turned on. When the voltage across the capacitor 637 falls below a predetermined value $V_{TH4}$ by discharge, the output of the comparator 638 falls to low level as shown in FIG. 8(*f*). Further, the output signal of the comparator 638 and the $\overline{Q}$ output of the flip-flop 610 are applied to the AND gate 639, and the signal shown in FIG. 7(*i*) is produced from the AND gate 639. The fall of this output is differentiated by the differentiation circuit 20 to set the flip-flop 610, thus inverting the output of the same flip-flop. As a result, the conduction time of the FET 11*a* is controlled to a length equal to that of the power transistor 6 (by the current-responsive conduction time-determining means 60C for rendering a uniform turn-off current value). This operation is repeated as long as the spark duration signal IGw is generated.

Figure 9:
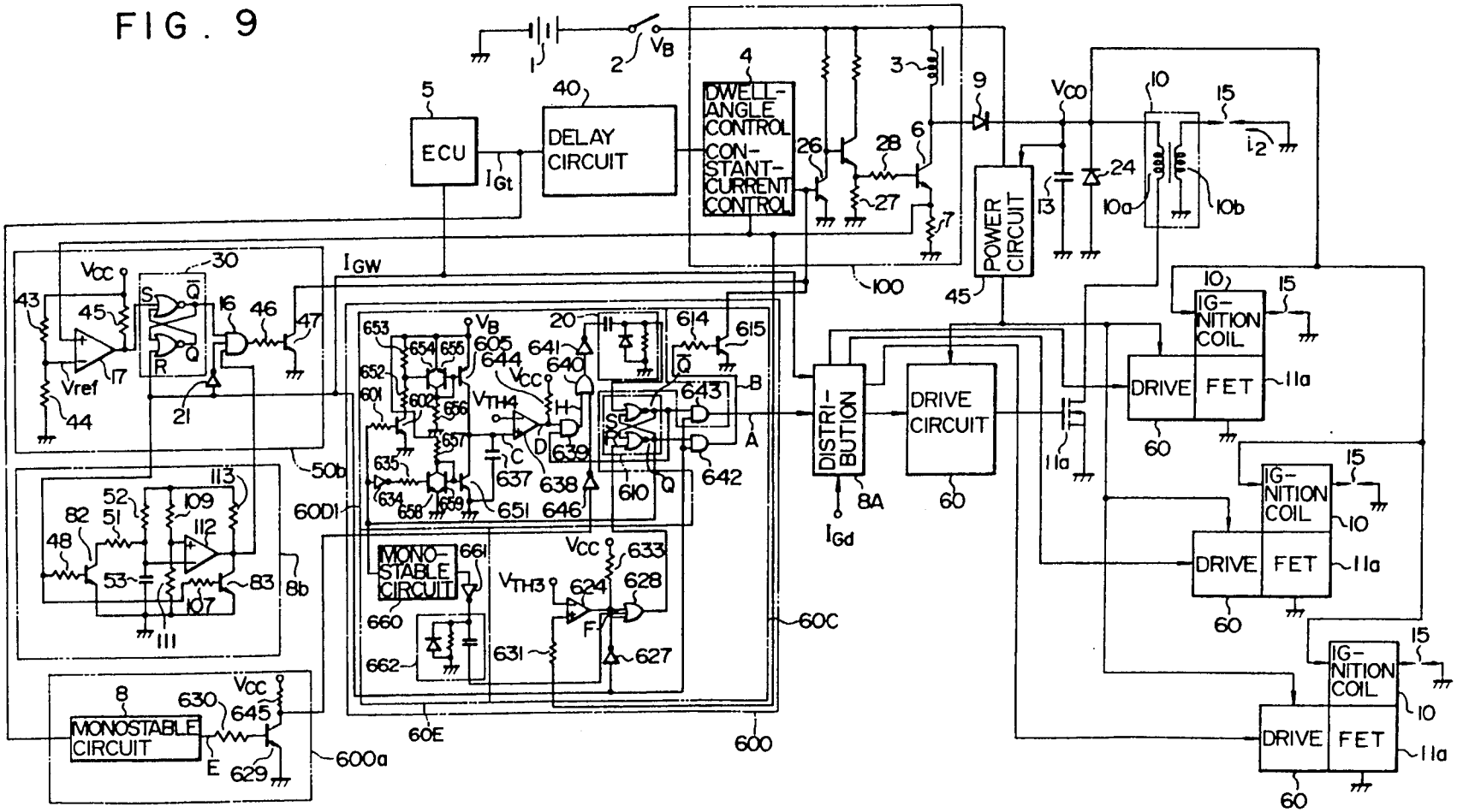
FIG. 9 is a diagram showing an electrical circuit according to a fifth embodiment of the present invention.

A fifth embodiment of the present invention is shown in FIG. 9. As compared with the fourth embodiment described above, the first switching device-responsive conduction-time determining means 60D1 uses a source voltage-responsive constant-current charge-discharge circuit including transistors 602, 605, 651, 654, 655, 658, 659 and resistors 601, 635, 652, 653, 656, 657 for charging and discharging the capacitor 637. Also, conduction time limiting means 60E is added, which includes a monostable multivibrator circuit 660 for generating a high-level output of a predetermined time width (say, 100 $\mu$s) with the rise of the $\phi$ output of the flip flop 610 to high level, an inverter 661 adapted to invert the output of the monostable multivibrator circuit 660 and a differentiation circuit 662 for differentiating the output of the inverter 661 and supplying one of the inputs of the OR gate 628.

According to the fifth embodiment, even when the conduction time of the power transistor 6 exceeds a predetermined value during generation of the spark duration signal IGw under low source voltage or high secondary load, the output of the monostable multivibrator circuit 660 resets the flip-flop 610 by way of the inverter 661, the differentiation circuit 662 and the OR gate 628 thereby to turn off the power transistor 6, while at the same time turning on the FET 11*a*, if the current flowing in the power transistor 6 fails to reach a determined value. As a consequence, the power transistor 6 and the FET 11*a* are alternately turned on and off thereby to maintain the continuity of spark during the spark duration even under a low source voltage or high secondary load.

Figure 10:
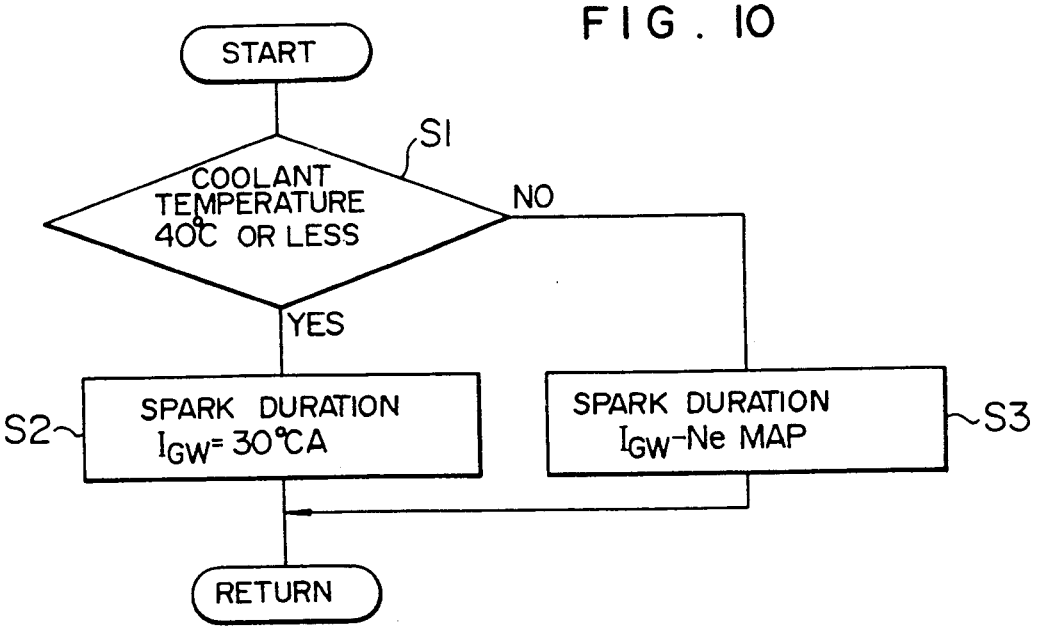
FIGS. 10 and 11 are flowcharts for explaining the operation of a sixth embodiment of the present invention.
Figure 11:
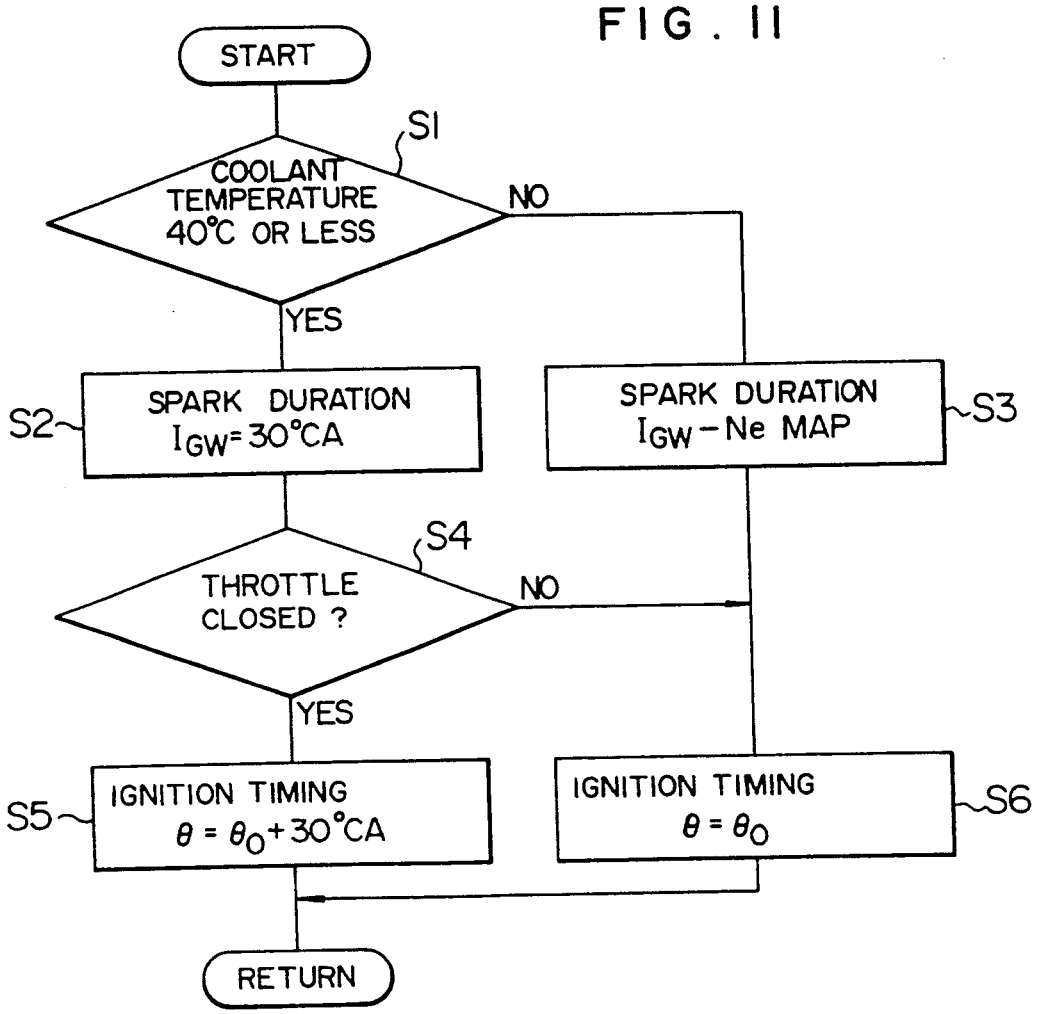
Figure 12:
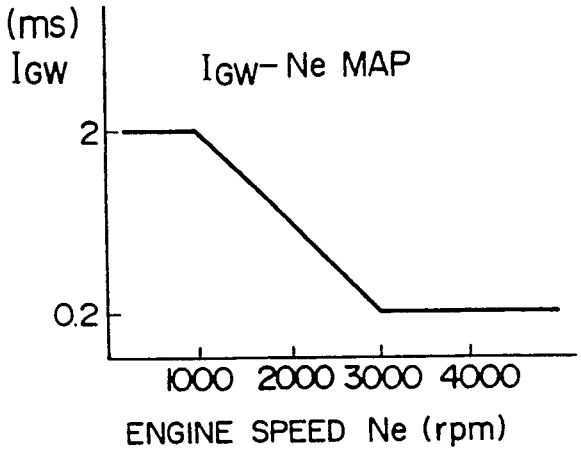
FIG. 12 is a characteristics diagram showing the spark duration against the rotational speed according to the sixth embodiment of the invention.

The ignition system of multispark type described above will be explained more in detail below with reference to a sixth embodiment of the present invention providing an anti-fouling ignition type combined with a spark-cleaning ignition plug disclosed in U.S. Pat. No. 4,845,400. Although the spark duration signal IGw is set to a predetermined value (say, 30° CA) in each of the above-mentioned embodiments, the present embodiment has a spark duration signal IGw rendered variable in accordance with the engine conditions by spark period control means included in software fashion in the ECU 5. A flowchart executed in the ECU 5 is shown in FIGS. 10 and 11. In FIG. 10, step S1 decides whether the engine coolant temperature is lower than 40° C. or not, and if the engine coolant temperature is lower than 40° C., the process proceeds to step S2 for lengthening the spark duration IGw to 30° CA. If the engine coolant temperature exceeds 40° C., by contrast, the process proceeds to step S3 for determining the spark duration IGw by an IGw-Ne map storing the spark duration IGw as related to the engine speed Ne as shown in FIG. 12. When the engine speed Ne is equal to or lower than 1000 rpm, IGw is set to 2 ms; when Ne is equal to or higher than 3000 rpm, IGw is set to 0.2 ms; and when Ne is between 1000 and 3000 rpm, IGw is set between 0.2 ms and 2 ms, for example.

In FIG. 11, in addition to the engine coolant temperature as in FIG. 10, the engine idling or deceleration is decided by a throttle switch thereby to advance the ignition timing by 30° CA from the normal ignition timing $\phi_0$.

Specifically, step S4 decides whether the throttle switch adapted to close when the throttle valve of the internal combustion engine is closed up is closed or not, and if it is decided that the throttle switch is closed, the process proceeds to step S5 for advancing the ignition timing by 30° CA from the ignition timing $\phi_0$ normally computed. When step S4 decides that the throttle switch is open, in contrast, the process proceeds to step S6 for setting the ignition timing to $\phi_0$ as computed normally.

The ignition plug of spark-cleaning type disclosed in U.S. Pat. No. 4,845,400 from which carbon is removed more easily with the increase in inductive discharge energy, extremely improves the self-cleaning ability of the ignition plug if combined with an ignition system of multispark type with a long spark duration. If the spark duration is lengthened in all cases, however, the electrodes of the ignition plug would be consumed earlier. Therefore, it is lengthened only while the engine is cold, and is set to a normal spark duration after the engine is warmed up. Generally, the smoldering of the ignition plug occurs while the engine is cold. In view of the fact that the engine coolant remains below 40° C. in temperature only for a very short period of time from the viewpoint of the whole operation time of the vehicle, however, the consumption of the ignition plug electrodes is not substantially affected if the spark duration is lengthened during such a period.

Further, the ignition timing may be advanced only during engine idling or deceleration as shown in FIG. 11. If the ignition timing is advanced, the voltage demand of the engine decreases advantageously for improving the smoldering performance.

Figure 13:
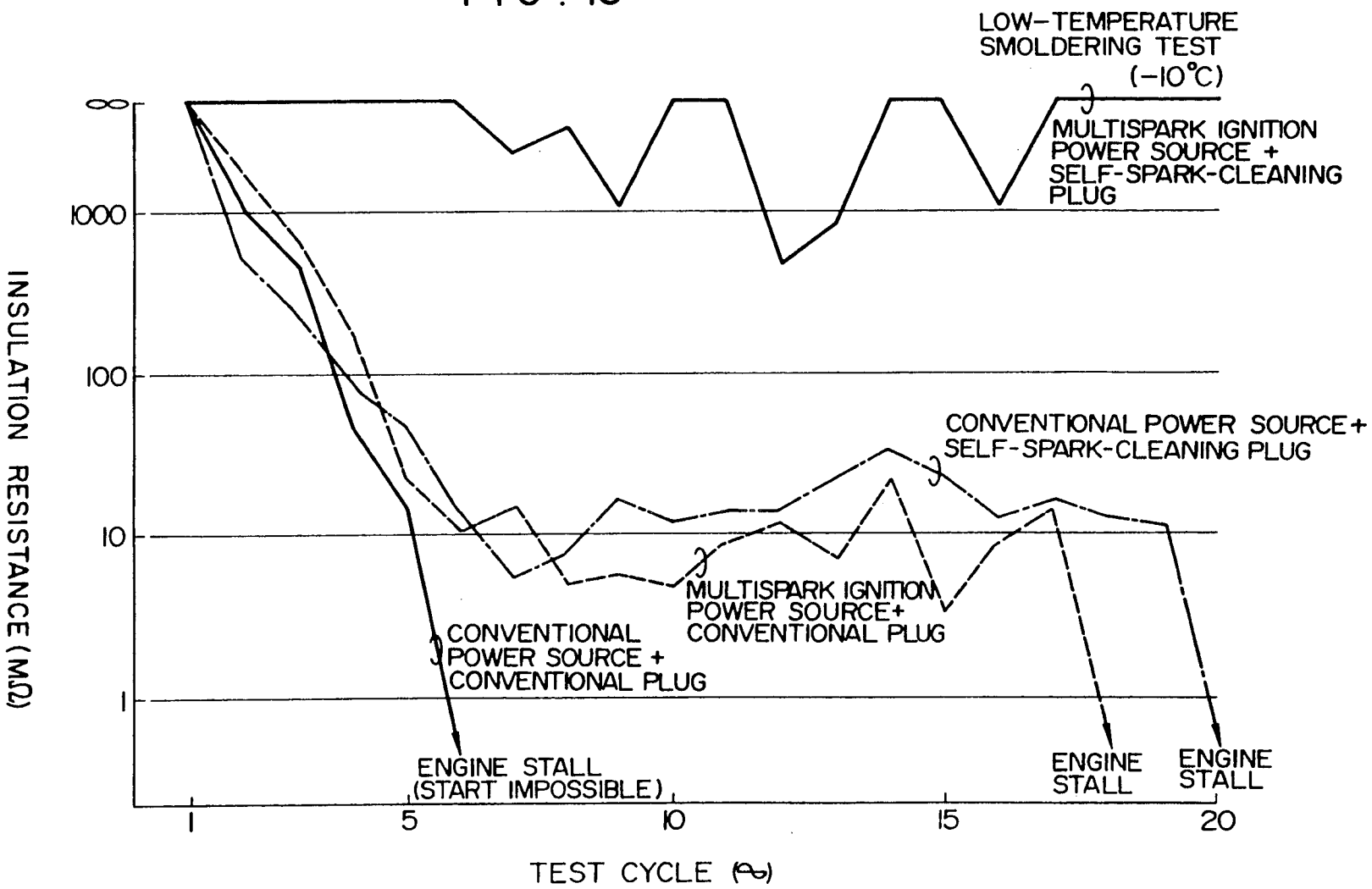
FIG. 13 is a characteristics diagram showing the insulation resistance as against the test cycle result according to the sixth embodiment of the present invention.

FIG. 13 shows the result of a smoldering test conducted on the ignition plug at low temperatures when carbon is easily deposited. A water-cooled four-cylinder four-cycle 1300 cc internal combustion engine was subjected to a test pattern of start, racing and idling in that order with the radiator coolant temperature at −10° C.±1° C. under ambient temperature of −20° C. as a condition easily causing carbon to be deposited. The test was conducted in cycles of one minute for evaluation. The abscissa represents the test cycle, and the ordinate the insulation resistance of the ignition plug. In the case of "a conventional power source with a conventional plug" the insulation resistance of the ignition plug is decreased with the increase in test cycles, until the engine is stalled upon six cycles. In the case of a conventional power source with a self-spark-cleaning plug, the insulation resistance decreases with the increase in test cycles, but sustains the same level for some time at about 10M ohm, even though the engine is still stalled upon 18 cycles. In the case of multispark ignition power source with a conventional plug", the insulation resistance decreases with the increase in test cycles, but sustains the same level for some time at about 10M ohm, even though the engine is still stalled upon 20 cycles. According to a "multispark ignition power source with a self-spark-cleaning plug" on the other hand, the insulation, which slightly drops with the increase in test cycles, is restored to prevent an engine stall.

Although the criterion of the decision at step S1 in the flowchart of FIGS. 10 and 11 is set to 40° C. or lower in coolant temperature, a given temperature may be set between 0° C. and 60° C. for decision in cold engine state. The spark duration, which has been set to 30° CA in the aforementioned embodiments, may be set at a given angle or time between 10° CA and 60° CA.

Also, instead of using the throttle switch for deciding the conditions for advancing the ignition timing as in FIG. 11, a light load may be decided as when the negative intake pressure is at a predetermined value (say, 300 mmH or more) or from a map defining negative pressure of the intake manifold as against engine speed. Further, the advance of the ignition timing under this condition may be set not to 30° CA but to a given angle between 10° CA and 60° CA.

Figure 14:
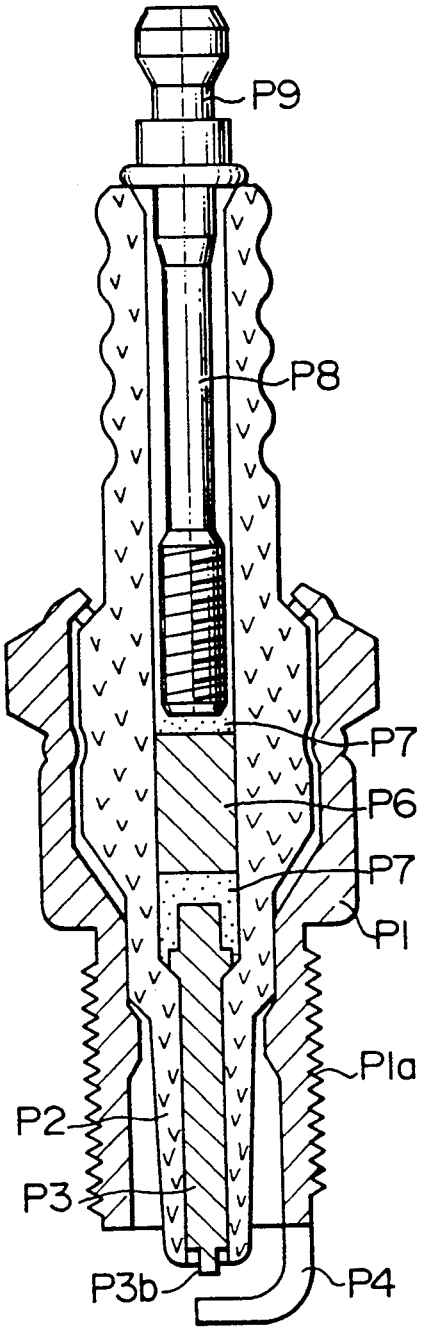
FIGS. 14 and 15 are a longitudinal sectional view and an enlarged partially cut-away longitudinal sectional view of an ignition plug of spark-cleaning type used in the sixth embodiment.
Figure 15:
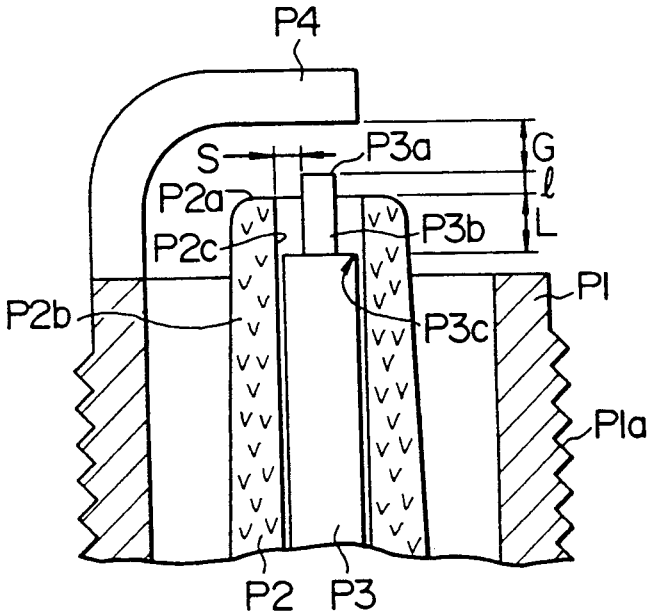

FIGS. 14 and 15 show an ignition plug of self-spark-cleaning type used for the sixth embodiment described above. A metal housing P1 has an insulating member P2 fixed on the interior thereof. The insulating member P2 has an inner aperture P2c in the central part thereof. The inner aperture P2c on the side of that leg P2b of the insulating member P2 which is exposed to the combustion chamber of the internal combustion engine has a central electrode P3 held therein. The central electrode P3 has a forward end thereof formed with a portion smaller in diameter than the other portions. An edge P3c is formed on the central electrode P3 by the small-diameter portion P3b. The forward-end surface P3a of the small-diameter portion P3b is projected from the forward-end surface P2a of the insulating member P2, thereby forming an air-borne spark gap between the forward-end surface P2a and an earth electrode P4. The earth electrode P4 is fixedly welded to the forward-end surface of the housing P1.

In FIGS. 14 and 15, reference character P1a designates a mounting screw for the housing 1, P6 a resistor, P7 a conductive glass layer, P8 a terminal shaft, and P9 a terminal.

As disclosed in U.S. Pat. No. 4,845,400, the distance S between the side of the inner aperture P2c of the insulating member P2 and the side of the small-diameter portion P3b of the central electrode P3 is set to 0.25 mm to 1.3 mm; the axial distance between the forward-end surface P2a of the insulating member P2 and the base end of the small-diameter portion P3b of the central electrode P3 to a range $0 < L \leqq 1.2$ mm; and the distance l between the forward-end surface 3*a* of the central electrode 3 and the forward-end surface 2*a* of the insulating member 2 to a range from 0 mm to 1.0 mm.

In an ignition plug of self-spark-cleaning type, the distance S between the side of the large-diameter portion of the inner aperture of the insulating member holding the central electrode inside the inner aperture and the side of the forward end of the central electrode is desirably between 0.25 mm and 1.3 mm. If the distance is smaller than 0.25 mm, it would be impossible to obtain the effect of dissipating the carbon deposited on the side of the inner aperture by generating a spark discharge through the carbon with a small-diameter portion formed at the forward end of the central electrode in order to avoid current leak by carbon. The result would be undesirably an anti-fouling characteristic equivalent to that of conventional general plugs.

The distance S larger than 1.3 mm, on the other hand, would extremely reduce the diameter of the small-diameter portion at the forward end of the central electrode, which small-diameter portion would fuse off and fail to fulfill the functions thereof in practical applications. If the distance is increased beyond 1.3 mm by increasing the diameter of the inner aperture of the insulating member without changing the diameter of the small-diameter portion of the central electrode, by contrast, the side area of the inner aperture would increase, thus causing more carbon to be deposited. The result would be an unsuccessful dissipation by burning of carbon and a current leak generated through the carbon.

The axial distance L between the base of the small-diameter portion of the central electrode and the forward-end surface of the insulating member is preferably $0<L\leqq 1.2$ mm, and if the distance L is not included in this range, the distance of spark discharge through the carbon deposited on the insulating member would be lengthened, thus making the spark discharge through the carbon difficult. Failure to burn off carbon and a current leak would be a result.

Also, the distance l between the forward-end surface of the central electrode and the forward-end surface of the insulating member is preferably between 0 mm and 1.0 mm. The value l being 0 is associated with the forward-end surface of the insulating member being in alignment with that of the central electrode. If the distance l is decreased below zero, that is, if the forward-end surface of the central electrode is positioned inward of the inner aperture of the insulating member, the flame core generated by ignition of a mixture gas at spark position is prevented from expanding by the inner aperture of the insulating member. The resultant unsatisfactory growth of the flame core, accompanied by inferior ignitability of the mixture gas, would make it impossible to use a diluted mixture gas.

If the distance l between the forward-end surface of the central electrode and that of the insulating member increases beyond 1.0 mm, by contrast, the forward-end surface of the central electrode tends to come away from that of the insulating member, so that the spark discharge distance through carbon is lengthened as in the above-mentioned case of distance L being displaced out of a specified range, thereby causing a similar problem.

In this case, the multispark time may be lengthened at low temperatures by spark period control means.

The ignition plug of self-spark-cleaning type applied to the aforementioned sixth embodiment is not confined to the one disclosed in U.S. Pat. No. 4,845,400 but may take any of various forms as disclosed in JP-A-56-51476, JP-A-58-40831 and JP-A-56-41685.

As explained above, according to the present invention, a first control signal generation means is used to turn on a first switching device a predetermined time before an ignition timing thereby to store energy in an energy storage coil, after which the first switching device is turned off at the ignition timing, from which a second switching device is turned on by multispark control signal generation means, so that the primary winding of an ignition coil is supplied with the energy stored already in a capacitor and the energy stored in the energy storage coil. During a subsequent predetermined spark period, the multispark control signal generation means generates a multispark control signal for turning on and off the first and second switching devices alternately, whereby ignition energy is periodically supplied to the ignition coil from the energy storage coil during the spark period. Second control signal generation means is used to turn on the first switching device at the time of turning off of the second switching device thereby to store energy in the energy storage coil, after which the first switching device is turned off to charge a capacitor by the energy stored in the energy storage coil. An ignition performance at least equivalent to a combination of an ignition system of capacitor discharge type with a multispark system is assured with a comparatively simple configuration without any exclusive DC-DC converter which otherwise might be necessary for charging the capacitor.

If the second control signal generation means is constructed to operate in synchronism with the end of generation of a multispark control signal from the multispark control signal generation means, it is possible to charge the capacitor immediately after a multispark in preparation for the next spark.

Also, if the first turn-on time of the second switching device started by the multispark control signal generation means at an ignition timing is set to a length different from that during the subsequent spark period by conduction time setting means, then the conduction time of the second switching device is lengthened by the time corresponding to the first capacitor discharge, thus stabilizing subsequent multiple discharge.

Further, the turn-on time of at least one of the first and second switching devices started by the multispark control signal generation means may be determined in accordance with the source voltage of a DC power supply by source voltage-responsive conduction time-determining means in order to stabilize the multispark against variations in source voltage.

Furthermore, if the turn-on time of the first switching device started by the multispark control signal generation means is determined in accordance with the current flowing in the first switching device by current-responsive conduction time-determining means, the energy stored in the energy storage coil is further stabilized for an improved stabilization of multispark.

What is more, if the turn-on time of the second switching device started by the multispark control signal generation means is determined in accordance with the conduction time of the first switching device by first switching device-responsive conduction time-determining means, the discharge of energy stored in the ignition coil is controlled in more satisfactory manner in accordance with the energy stored in the energy storage coil.

Besides, if conduction time limiting means is used to turn off the first switching device when the turn-on time of the first switching device determined by the current-responsive conduction time-determining means exceeds a predetermined value under a low source voltage or high secondary load, then the continuity of spark is maintained for the spark duration under low source voltage or high secondary load.

In addition, if the ignition plug of self-spark-cleaning type is discharged in multiple way by the ignition energy periodically supplied to the ignition coil, the self-cleaning ability of the ignition plug is extremely improved.

Also, by lengthening the multispark period by spark period control means at low temperatures, the multispark period is shortened at high temperatures where carbon is difficult to deposit, while maintaining the self-cleaning ability of the ignition plug at low temperatures where carbon is easy to deposit on the ignition plug, thereby reducing the consumption of the electrodes of the ignition plug.

We claim:

1. An ignition system of multispark type comprising:
   a first series closed circuit including a DC power supply, an energy storage coil and a first switching device;

a second series closed circuit including the energy storage coil, a reverse flow blocking means, the primary winding of the ignition coil and a second switching device;

a capacitor connected to the energy storage coil through the reverse flow blocking means;

first control signal generating means for generating a first control signal for cutting off the first switching device at an ignition timing after being turned on a predetermined time before the ignition timing to store energy in the energy storage coil;

means for generating a multispark control signal for turning on and off the first and second switching devices alternately during a predetermined spark period after turning on the second switching device from the ignition timing;

means for generating a second control signal for charging the capacitor with the energy stored in the energy storage coil by turning off the first switching device after being turned on to store energy in the energy storage coil while the second switching device is turned off, and current-responsive conduction time-determining means whereby the turn-on time of the first switching device started by said multispark control signal generation means is determined in accordance with the current flowing in the first switching device.

2. An ignition system of multispark type according to claim 1, further comprising conduction time setting means for setting the first turn-on time of the second switching device started by the multispark control signal generation means at an ignition timing, separately from the turn-on time during the subsequent multispark period.

3. An ignition system of multispark type according to claim 1, further comprising first switching device-responsive conduction time-determining means whereby the turn-on time of the second switching device started by the multispark control signal generation means is determined in accordance with the conduction time of the first switching device.

4. An ignition system of multispark type according to claim 3, further comprising a spark cleaning type ignition plug connected to the secondary winding of the ignition coil.

5. An ignition system of multispark type according to claim 4, wherein said ignition plug of the spark cleaning type includes a central electrode, an insulating member for holding the central electrode inside an inner aperture, a metal housing fixed on the outer periphery of the insulating member, and an earth electrode provided on the housing, an air-borne spark gap is formed between the forward-end surface of the central electrode and the forward-end surface of the earth electrode, said central electrode includes a small-diameter portion at the forward end thereof, the distance between the side of the small-diameter portion and the side of the inner aperture of the insulating member is set to 0.25 mm to 1.3 mm, the base of the small-diameter portion of the central electrode is positioned within the range of 1.2 mm from the forward-end surface of the insulating member, and the distance between the forward-end surface of the central electrode and the forward-end surface of the insulating member is set to 0 mm to 1.0 mm.

6. An ignition system of multispark type according to claim 4, further comprising spark duration control means for lengthening the discharge period at low temperatures.

7. An ignition system of multispark type according to claim 1, further comprising conduction time limiting means for turning off the first switching device regardless of the output of the current-responsive conduction time-determining means when the conduction time of the first switching device determined by the current-response conduction time-determining means exceeds a predetermined value.

8. An ignition system of multispark type comprising:

a first series closed circuit including a DC power supply, an energy storage coil and a first switching device;

a second closed circuit including the energy storage coil, a reverse flow blocking means, the primary winding of the ignition coil and a second switching device;

a capacitor connected to the energy storage coil through the reverse flow blocking means;

first control signal generating means for generating a first control signal for cutting off the first switching device at an ignition timing after being turned on a predetermined time before the ignition timing to store energy in the energy storage coil;

means for generating a multispark control signal for turning on and off the first and second switching devices alternately during a predetermined spark period after turning on the second switching device from the ignition timing;

means for generating a second control signal for charging the capacitor with the energy stored in the energy storage coil by turning off the first switching device after being turned on to store energy in the energy storage coil while the second switching device is turned off, said second control signal generation means operating in synchronism with the end of generation of a multispark control signal from said multispark control signal generation means, conduction time setting means for setting the first turn-on time of the second switching device started by the multispark control signal generation means at an ignition timing, separately from the turn-on time during the subsequent multispark period, and current-responsive conduction time-determining means whereby the turn-on time of the first switching device started by said multispark control signal generation means is determined in accordance with the current flowing in the first switching device.

9. An ignition system of multispark type according to claim 8 further comprising first switching device-responsive conduction time-determining means whereby the turn-on time of the second switching device started by the multispark control signal generation means is determined in accordance with the conduction time of the first switching device.

* * * * *